United States Patent [19]

Tazawa et al.

[11] Patent Number: 4,725,169

[45] Date of Patent: Feb. 16, 1988

[54] GROUT IMPREGNATION METHOD

[75] Inventors: Shunsuke Tazawa, Tokyo; Kenji Takeuchi, Yokohama; Akiyoshi Horiba, Tokyo; Mitsuji Ishida, Yokohama; Syouichi Kashima, Sagamihara; Mineo Murata, Tokyo, all of Japan

[73] Assignees: Nitto Chemical Industry Co., Ltd.; Nihon Soil Engineering Co., Ltd.; Yamaguchi Kikai Kogyo Co., Ltd.; Nihon Sogo-Bosui Co., Ltd., all of Tokyo, Japan

[21] Appl. No.: 941,253

[22] Filed: Dec. 12, 1986

[30] Foreign Application Priority Data

Mar. 4, 1986 [JP] Japan ..... 61-47058
Mar. 4, 1986 [JP] Japan ..... 61-47059

[51] Int. Cl.[4] ..... E02D 3/12

[52] U.S. Cl. ..... 405/269; 405/260; 405/303

[58] Field of Search ..... 405/269, 260, 303, 258, 405/262, 266, 241, 233, 263

[56] References Cited

U.S. PATENT DOCUMENTS 3,518,834 7/1970 Gnaedinger et al. ..... 405/269
3,986,536 10/1976 Janson ..... 405/269 X
4,302,132 11/1981 Ogawa et al. ..... 405/269
4,449,856 5/1984 Tokoro et al. ..... 405/269

FOREIGN PATENT DOCUMENTS 0075017 6/1980 Japan ..... 405/269
0081517 5/1982 Japan ..... 405/269
0062212 4/1983 Japan ..... 405/269

*Primary Examiner*—Dennis L. Taylor
*Attorney, Agent, or Firm*—Flynn, Thiel, Boutell & Tanis

[57] ABSTRACT

An improved grout impregnation method which uses an injection tube for contacting and mixing different kinds of materials supplied thereinto separately to prepare a grout and impregnates the grout into the earth through an injecting opening provided at a tip end of the tube.

In this method, a first pressure-holding valve is provided within a higher-pressure path for one of the materials which is supplied under a higher pressure, a mixing section is provided downstream the first pressure-holding valve but in the vicinity thereof for contacting and mixing said one of the materials with another one which is supplied under a lower pressure, and a second pressure-holding valve is provided downstream the mixing section; said one of the materials is passed through the first pressure-holding valve, which reduces the pressure of said one of the materials, and then contacted and mixed with said another one at the mixing section; the contacting and mixing is carried out under a pressure exceeding an atmospheric pressure and determined by the second pressure-holding valve; and the grout resulting from the contacting and mixing and passing through the second pressure-holding valve is impregnated into the earth through the injection opening.

11 Claims, 10 Drawing Figures

GROUT IMPREGNATION METHOD

BACKGROUND OF THE INVENTION

1. Field of the Invention

This invention relates to a grout impregnation method and more particularly to a method for impregnating two-part curable grout, for example a composite grout comprising water glass and carbonated water or carbon dioxide gas, into soil to stabilize the earth.

2. Related Arts

In an early grout impregnation method, a single-liquid grout was used. Thereafter, various improvements have been introduced into this method. For example, two liquids, which are curable when they react each other, are used as a grout (two-part curable grout) in such a manner that they are mingled in a Y-shaped pipe provided at a base portion of an injection tube. Recently, a further improvement has been made and a method has become predominant in which the two liquids are mingled and mixed within the injection tube and the resulted grout is injected into the earth.

Although various kinds of two-part curable grouts have been known, a grout containing water glass (sodium silicate) is most widely used today because it does not pollute the soil. Water glass may be used with a reactant such as an acid or a salt of the acid.

Water glass may alternatively be used with a reactant of carbonated water to provide a grout to be impregnated into the earth for stabilization of the soil. This is disclosed, for example, in Japanese Kokai No. 53-74709.

Carbon dioxide gas has such an advantage that it is less expensive and harmless. However, to prepare carbonated water by absorbing carbon dioxide gas in water and to use the resultant carbonated water with water glass as a grout, there is a problem to be solved as will be described later. By this reason, this grout has not been put into practical use heretofore.

Such a reaction is given by:

$$2H^{+}+CO_3^{2-}+Na_2O \\ nSiO_2 \rightarrow Na_2CO_3+H_2O+nSiO_2$$

Thus, when carbonated water and water glass are impregnated into the soil after their mixing, silica and sodium carbonate are produced in the soil to solidify flimsy portions of the earth, stabilizing the same.

In the conventional grout impregnation using a two-part curable grout, it has been considered essential to mix the two liquids supplied in equal amounts under equal pressures. The conventional grout impregnation of this type, in effect, is carried out by mixing the two liquid-parts of equal amounts under equal pressures.

However, when carbonated water is preliminarily prepared and supplied to the injection tube, carbonated water is liable to be separated into water and carbon dioxide gas if the pressure within the tube is not high enough, and can not be reacted sufficiently with water glass. On the other hand, when it is required to prepare carbonated water at an execution site, water and carbon dioxide gas must be contacted under a high pressure in a closed vessel to obtain carbonated water of high concentration. By this reason, carbonated water should inevitably be led to the injection tube under a high pressure. In addition, the pressure within the dissolving vessel for preparing carbonated water should be increased to shorten a gelling time of the grout as shown in FIG. 10.

If carbonated water is thus supplied into the injection tube under a high pressure and water glass is supplied thereinto under a lower pressure, the flow of carbonated water become dominant within the tube and the two liquids are not reacted sufficiently.

A valve provided after the mixing of two liquids has been known. However, the known valve after the mixing of the liquids is a check valve for preventing back flow of soil into the injection tube after injection of the grout into the soil, and not a valve for holding a pressure of the mixing section. A valve is not provided, in a conventional technique, upstream the mixing section.

OBJECTS OF THE INVENTION

It is therefore an object of the present invention to provide a grout impregnation method which allows components of a curable grout to contact, mix and react with each other sufficiently and positively to prepare the grout which is capable of developing sufficient strength.

It is another object of the present invention to provide a grout impregnation method which enables sufficient mixing of materials when one material is supplied under a higher pressure than the other in such a case of carbonated water or cabon dioxide gas and water glass used as components of a two-part curable grout.

SUMMARY OF THE INVENTION

The present invention features a grout impregnation method which uses an injection tube for contacting and mixing therein different kinds of materials supplied separately thereinto to prepare a grout and impregnates the prepared grout into the earth through an injecting opening provided at a tip end of the tube, which method is characterized in that: a first pressure-holding valve is provided within a higher-pressure path for one of the materials which is supplied under a higher pressure, a mixing section is provided downstream said first pressure-holding valve but in the vicinity thereof for letting said one of the materials contact and mix with another one which is supplied under a lower pressure, and a second pressure-holding valve is provided downstream the mixing section; said one of the materials is passed through said first pressure-holding valve, which reduces the pressure of said one of the materials, and then contacted and mixed with said another one at the mixing section; the contacting and mixing is carried out under a pressure exceeding atmospheric pressure and determined by the second pressure-holding valve; and the grout resulting from said contacting and mixing and passed through the second pressure-holding valve is impregnated into the earth through the injecting opening of the tube.

The present inventors have conducted various laboratory tests and pilot tests to achieve a grout impregnation method using water glass and carbonated water or carbon dioxide gas and found that there are some problems to be solved. Among these is a problem that carbonated water and water glass are impregnated into the earth possibly without being reacted sufficiently, deteriorating the soil stabilizing effect, if they are kept at a high pressure and subjected to a reaction for a sufficient time. More particularly, unless the material liquids are mixed and reacted sufficiently, carbonated water and water glass are separately injected into the earth. Moreover, carbonated water is further separated into water and $CO_2$ gas. It has been observed that a desired grout is not obtained when the mixing and rection are not sufficient and that $CO_2$ gas bubbles up from the injecting opening of the tube.

This phenomenon can be explained as follows: when one of the material liquids, for example, carbonated water is supplied under a high pressure and another material liquid, for example, water glass is supplied under a lower pressure, if appropriate valve means are not provided for controlling the pressures and flow rates, carbonated water of a higher pressure becomes predominant in the flow and carbonated water is sprouted from the injecting opening of the tube without being sufficiently contacted, mixed and reacted with water glass. Carbonated water is further separated into carbon dioxide gas and water and carbon dioxide gas spurts out.

With the first pressure-holding valve provided within the path for the higher pressure material leading to the mixing section according to the present invention, the pressure after the first pressure-holding valve is kept lower than the actuation pressure of the valve. At this lowered, substantially equalized pressure, the material is made to contact and mix with the material which has been supplied under a lower pressure at the same supplying rate. As a result of this, the materials can be mixed with each other sufficiently and uniformly.

With the second pressure-holding valve provided between the mixing section and the injecting opening of the tube, the mixing section is held at a pressure substantially the same as the actuation pressure of the second pressure-holding valve. If the second pressure-holding valve is not provided, the pressure of the mixing section is substantially atmospheric. Under this condition, the materials of the grout can not be mixed well. Whereas, if the pressure of the mixing section is kept at 1 $kg/cm^2G$ or higher, preferably 3 $kg/cm^2G$ or higher, more preferably 5 $kg/cm^2G$ or higher, the materials are contacted and mixed with each other in the mixing section at a high pressure and they are mixed uniformly.

To obtain carbonated water of high concentration or a grout of shortened gelling time, the operating pressure within the dissolving vessel (packed absorber) for the preparation of carbonated water should be high as described above. For this reason, it may be possible to provide means for keeping the pressure within the packed absorber high and to provide a pressure reducing valve in a path for carbonated water leading to the injection tube. The mixing section is provided far downstream of the reducing valve for letting carbonated water contact with water glass. In this case, even if carbonated water and water glass may be supplied and mixed under equal pressures, it is not possible to obtain a uniform, homogeneous grout.

In contrast, it has been found that if the mixing section is provided within 2 m, preferably within 1 m, more preferably within 0.5 m from the first pressure-holding valve, the desired mixing of the materials can be attained. The reason of this is not known, but it may be inferred that the pressure of the carbonated water is rapidly reduced when carbonated water passes through the first pressure-holding valve and it is diffused into the flow of water glass.

The inventors have also found that mere contact of the two materials, carbonated water and water glass, is not sufficient to achieve sufficient reaction between them. In this case, carbonated water and water glass are impregnated into the earth separately. Whereas, if the materials are kept to dwell, for a sufficiently long time, within a space limited by and between the first pressure-holding valve and the second pressure-holding valve, sufficient reaction between the materials is attained. To improve the contact and mixing, the contacting and mixing zone may be prolonged. However, the injection tube is formed, in use, by coupling a plurality of tube members into a desired length. Therefore, the length of the tip tube member of the injection tube is limited and can not be lengthened as desired.

In a preferred embodiment of the present invention, a mixing accelerating section may be provided within the injection tube. In the mixing accelerating section, carbonated water and water glass flow a path consisting of at least one reciprocating path segment which is first directed towards the tip and then turns towards the base. Thus, an elongated or extended path length can be attained in a limited length of the tip tube member. As a result of this, sufficient reaction time can be obtained without elongating the tip tube member. This is also advantageous in maintenance and cleaning of the tube.

Before this invention, there has not been known an idea of reciprocating flow of the material mixture in an axial direction of the tube.

The present invention is suitably applied when the supplying pressures of the two materials of the two-part curable grout are different, especially when the ratio in supplying pressure of the higher-pressure material to the lower-pressure material is 1.2 or higher.

The actuation pressure of the first pressure-holding valve is preferably 0.5 times or more and 1.5 times or less the supplying pressure of the material passing through the valve. If the ratio is less than 0.5, the higher-pressure material passing through the first pressure-holding valve becomes too predominant over the lower-pressure material to be mixed with the latter uniformly.

When the desired grout comprises equal parts of two materials, the supplying rates of the liquids should be substantially equal. The ratio in supplying rate between the higher-pressure material and the lower-pressure material is preferably 0.7 to 1.3, more preferably 0.85 to 1.15 to attain uniform and homogeneous mixture. Of course, the above.

The present invention may also be applicable to the reaction between other known two-component system such as the reaction between carbon dioxide gas and water glass or the reaction between cement and water glass.

When the grout used has a shortened gelling time, it is preferred to provide the first pressure-holding valve, the mixing section and the second pressure-holding valve in the tip tube member of the injection tube to prevent clogging of the flow path of the grout due to curing of the grout. However, if a grout of longer gelling time is used, the valves and the mixing section may be provided at more upstream portions of the tube because there is no fear of clogging due to the curing of the grout.

The pressure-holding valve employable in the present invention may be valves biased by springs, or needle valves, or may be orifices. In other words, any kind of means may be employable as far as it operates to hold the pressure of the supplying line of the higher-pressure material, as the first pressure-holding valve or to keep the pressure within the mixing section or function as a check valve, as the second pressure-holding valve.

Thus, the word "valve" used herein should be interpreted widely.

DESCRIPTION OF PREFERRED EMBODIMENTS

Figure 1:
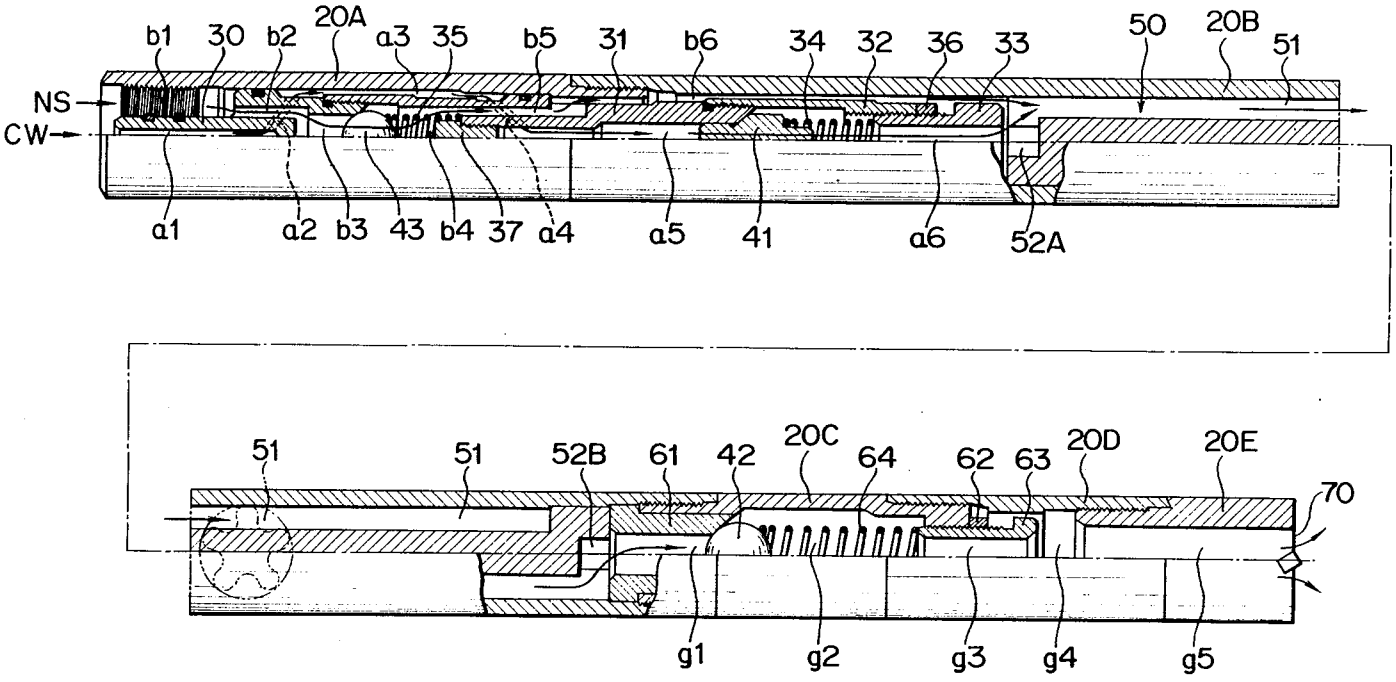
FIG. 1 is a half-sectional view of one form of a tip tube member of an injection tube according to the present invention.

The invention will now be described referring to the drawings.

Figure 4:
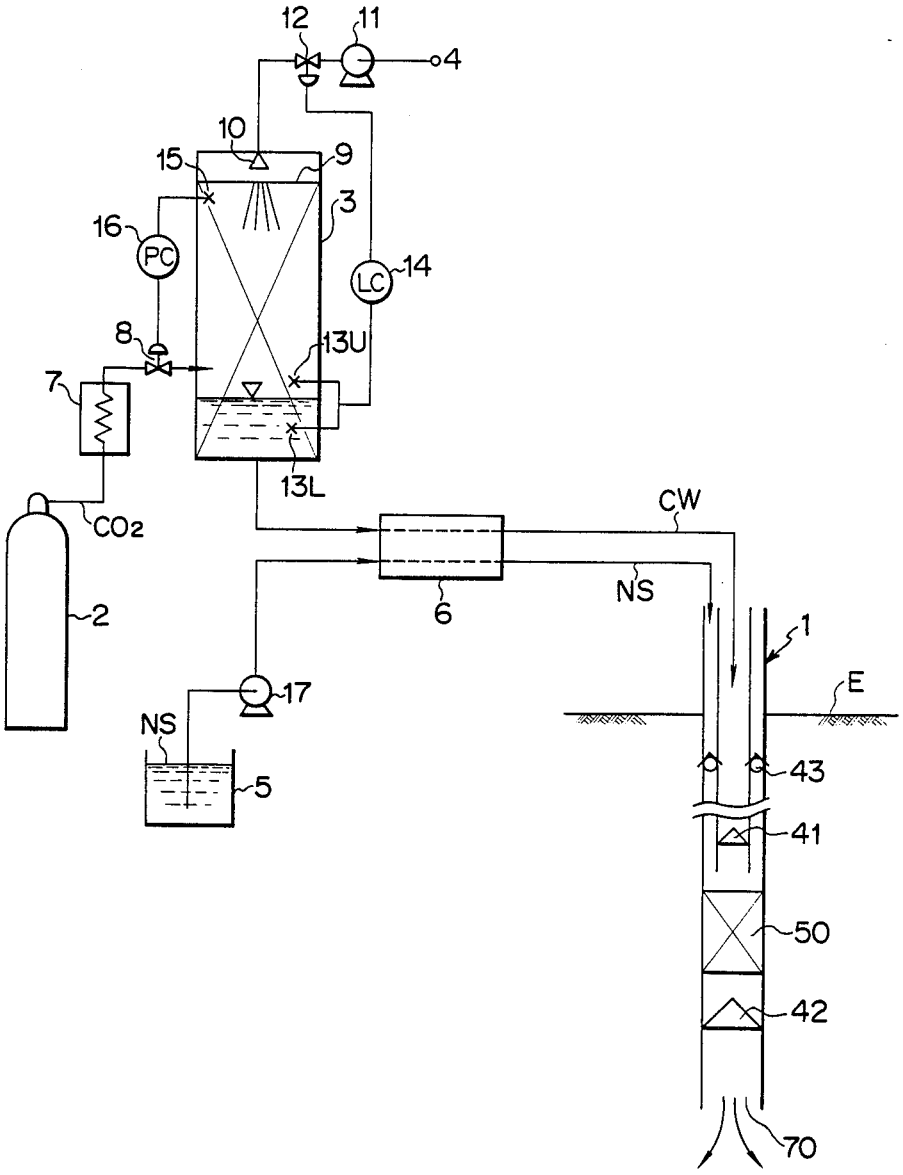
FIG. 4 is a block diagram showing an entire system for grout impregnation.
Figure 5:
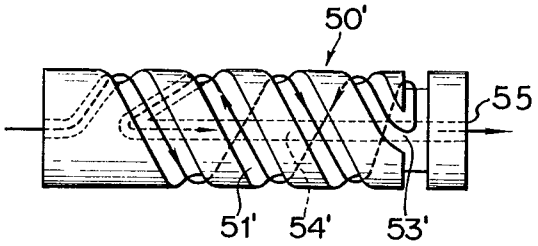
FIG. 5 is a perspective view of another form of mixing accelerator.

FIG. 4 illustrates an entire system for soil stabilization.

1 is an injection tube which is inserted into the earth E and set there for impregnating grout into an ambient portion of the ground. The injection tube 1 is used in combination with a grout supplying system consisting essentially of a carbon dioxide gas $CO_2$ source, e.g. a carbon dioxide gas bomb 2, a packed absorber 3, a water source 4, a water-glass tank 5 and a grouting pump 6. Carbon dioxide gas $CO_2$ from the gas bomb 2 is supplied to the absorber 3, preferably to a lower portion of the absorber 3 through a vaporizer 7 for enhancing vaporization especially in a winter season and a gas flow control valve 8. The absorber 3 has packings 9 such as saddles or Raschig rings packed therein. The absorber 3 further includes a spray nozzle 10 installed at an upper portion thereof for spraying water 4 fed by a pump 11 through a flow control valve 12.

Thus, the carbon dioxide gas and water are brought into contact with each other in the absorber 3 to produce carbonated water. At this time, the packings 9 enhance the gas-liquid contact. The carbonated water thus produced is drawn out from the bottom of the absorber 3 by the double acting pump 6 to be led, for example, into an inner path of the injection tube 1.

It is very crucial to balance the production of the carbonated water with the feed (or consumption) of the carbonated water by the pump 6. For this reason, an upper- and a lower-limit level detector 13U, 13L are provided at a lower portion of the absorber 3 in the present embodiment to control the water flow rate by operating the water flow control valve 12 by an liquid level controller 14 so that the liquid level of the carbonated water is kept between the upper- and lower-limit levels. In addition to the liquid level control, the concentration of carbon dioxide dissolved in the carbonated water is also to be controlled because it influences the reactivity of the carbonated water with water glass. To this end, a pressure detector 15 is provided within the absorber 3. The gas flow is controlled by operating the gas flow control valve 8 by a pressure controller 16 to control the carbonated water concentration.

On the other hand, water glass is drawn up from the tank 5 by a liquid feeding pump 17 and then led, for example, into an outer path of the injection tube 1.

Figure 2:
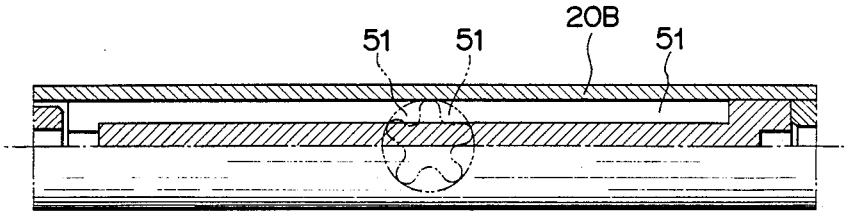
FIG. 2 is a half-sectional view of a principal portion of the injection tube shown in FIG. 1.
Figure 3:
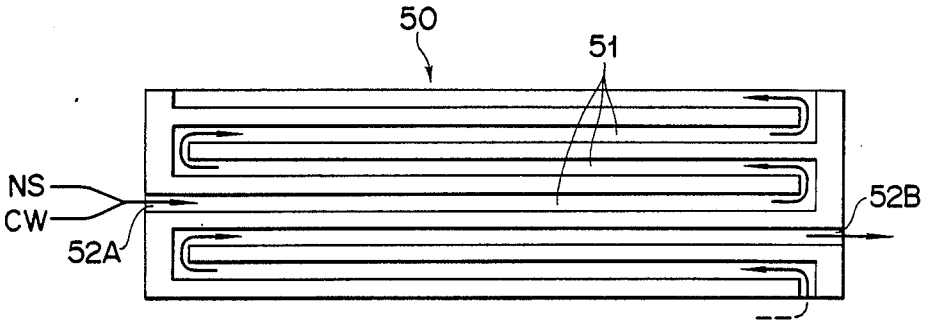
FIG. 3 is a front view of a mixing accelerator employable in the present invention.

Referring further to FIGS. 1 to 3, the carbonated water CW and the water glass NS are fed to a tip tube member of the injection tube as illustrated in FIG. 1 through a swivel joint (not shown) and a coupling barrel of a known double-tube structure.

The tip tube member comprises an outer pipe elements 20A to 20E within which various members as will be described below are provided.

At a base end portion of the tip tube member, a leading member 30, an intermediate member 31, a connecting member 32 and a trailing member 33 are threadedly engaged with each other and installed inside the tip tube member. The carbonated water CW first enters a first path a1 formed at a center of the leading member 30, passing through a plurality of second paths a2 formed so as to extend from a tip end of the first path a1 slantingly in a radial direction, through a third path a3 defined by a gap between the outer periphery of the leading member 30 and the inner surface of the outer pipe element 20A, and through a fourth path a4 formed so as to extend from a tip end of the third path a3 slantingly to a center of the outer pipe element 20A. The carbonated water CW is then led into a fifth path a5 formed at a central portion of the intermediate member 31 and further led to a sixth path a6 formed inside the trailing member 33, while pushing down a first dwelling or pressure-holding valve 41 which is biased by a spring 34 resting against the trailing member 33.

The water glass NS is introduced into a first path b1 formed by a gap between the outer periphery of the leading member 30 and the outer pipe element 20A and is forced to pass through a plurality of second paths b2 formed in the leading member 30 to extend along the axis thereof to reach a third path b3 formed centrally at the tip end portion of the leading member 30. The water glass then passes through a fourth path b4 within the intermediate member 31 while pushing down a check valve 43 urged by a spring 35 rested against the intermediate member 31 and passes through a plurality of fifth paths b5 formed within an increased diameter portion of the intermediate member 31 to extend along the axis thereof to reach a sixth path b6 formed by a gap between the outer peripheries of the intermediate member 31, the connecting member 32 and the trailing member 33 and the inner surfaces of the outer pipe elements 20A and 20B.

36 is a lock nut for locking the trailing member 33 relative to the intermediate member 32 after the force of the spring 34 is set by screwing the trailing member 33 to set an actuation pressure of the first pressure-holding valve 41. 37 is a guide for the spring 35.

A tip end portion of the trailing member 33 receives a mixing accelerator 50 fitted therein. A valve seat 61 for a second dwelling or pressure-holding valve 42 is disposed next to the tip end of the mixing accelerator 50. The second pressure-holding valve 42 is biased towards the valve seat 61 by a spring 64 resting against a seat 63 which is locked relative to the outer pipe element 20C by a lock nut 62.

The mixing accelerator 50 is fitted closely within the outer pipe element 20B. The mixing accelerator 50 is formed in a columnar shape and is, for example, about 25 cm in length. The mixing accelerator 50 has a groove on the outer periphery thereof. The groove comprises one or more reciprocating flow paths 51, five in the present embodiment. Each of the reciprocating paths is formed of a forward path section directed from a base to a tip and a backward path section returning to the base which communicate with each other. The groove further comprises an extra forward path for finally directing towards the tip end of the injection tube. Therefore, the materials flow along the groove of about 275 cm (25×5×2+25) in total. In general, the mixing accelerating path has a length of 0.5 m or more, preferably lm or more.

As can be understood from the foregoing description, the path system a1 to a6 for the carbonated water CW and the path system b1 to b6 for the water glass NS are separate from each other before the tip end of the trailing member 33. The carbonated water CW and the water glass NS first meet when they enter the mix accelerating path 51 through an entrance recess 52A at a base end of the mixing accelerator 50 after they have passed the tip end of the trailing member 33. These materials thereafter are mixed sufficiently while being subjected to reaction for a sufficient time during their course of flowing through the long mix accelerating path 51. The resultant mixed up grout leaves the mix accelerating path 51 through an exit 52B and enters within the valve seat 61, then passing through grout paths g1 to g5 therein to be injected into the earth E through an injecting opening 70 at the tip end of the injection tube 1.

In this connection, it is to be noted that only two reciprocating paths and one extra forwarding path are shown in section of the mixing accelerator 50 in FIGS. 1 and 2 to simplify the illustration.

As described above, the mixing accelerator 50 having the reciprocating paths can provide a desired length of mixing and reacting time prolonged as compared with that of the length of the mixing accelerator 50. Thus, the materials, the carbonated water and the water glass, can be mixed sufficiently and it can be avoided that the materials are impregnated as they are separate. Ordinary two-part curable grouts other than that specified herein may be used after simple mixing of the two parts. However, carbonated water is not easily mixed with water glass. For this reason, the mixing acceleration arrangement employed in the present embodiment is very effective for the grout consisting of carbonated water and water glass.

To handle carbonated water and water glass which are difficult to mix, it is desirable, as well as to prolong the reaction time, to mix them under a relatively high pressure within a mixing section (chamber), for example 1 kg/cm$^2$G or higher, preferably 3 kg/cm$^2$G or higher, more preferably 5 kg/cm$^2$G or higher.

To this end, the first pressure-holding valve 41 and the second pressure-holding valve 42 are provided before and after the mixing accelerator 50 in this embodiment. More specifically, to keep the mix accelerating path 51 at a relatively high pressure, carbonated water is supplied to the first pressure-holding valve 41 under a pressure of 5 kg/cm$^2$G or higher, preferably 10 kg/cm$^2$G or higher, more preferably between 15 kg/cm$^2$G and 40 kg/cm$^2$G. In addition, the actuating pressure of the second pressure-holding valve 42 is set to be 1 kg/cm$^2$G or higher, preferably 3 kg/cm$^2$G or higher, more preferably 5 kg/cm$^2$G or higher. With this arrangement, the pressure within the mixing section is kept at a pressure corresponding to the actuating pressure of the second pressure-holding valve 42. With respect to water glass NS, the check valve 43 is set so that it may operate when the dynamic pressure of the water glass acts on the valve. The pressure for supplying the water glass is 1.5 to 10 kg/cm$^2$G, preferably 3 to 7 kg/cm$^2$G.

In a conventional injection tube, a check valve operates when a dynamic pressure is applied, whereas in this embodiment, the pressure-holding valves 41 and 42 are provided to keep the mix accelerating section between the pressure-holding valves 41 and 42 at a desired high pressure, which is novel in the grout impregnation method.

The mixing accelerator 50 of the present embodiment may be replaced by a mixing accelerator 50' having a helical mix accelerating path 51'. In this case, the helical path consists of two helical path segments disposed alternatingly. These helical path segments communicate each other at a turning point 53' and one is directed to a tip end and another returns to a base. The returning path segment further communicates at the base end thereof with a center path 54' which opens at a tip end 55 thereof.

Figure 6:
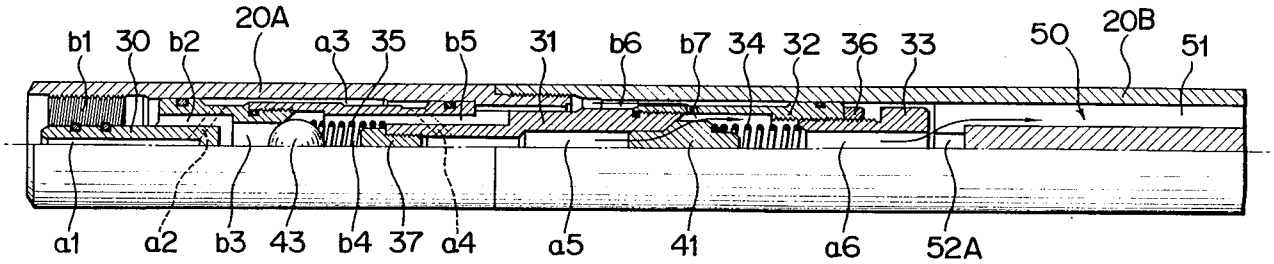
FIG. 6 is a half-sectional view of another form of a tip tube member of an injection tube employable in the present invention.

The water glass and the carbonated water may alternatively be brought- into contact with each other at a position upstream from the mixing accelerator 50 as illustrated in FIG. 6. In this case, the water glass NS passes through a seventh path b7 formed in a wall of the connecting member 32 and is brought into contact with the carbonated water CW at a position adjacent to and downstream from the first pressure-holding valve 41.

In this connection, it is to be noted that a plurality of mix accelerators may be combined in an axial direction of the tube. The injecting opening 70 may be set back from the tip end face of the injection tube 1. The injection tube 1 may have a triple-flow path structure. In this case, two flow paths may be used for grout feeding and one flow path is used for water feeding at a time of boring.

Figure 7:
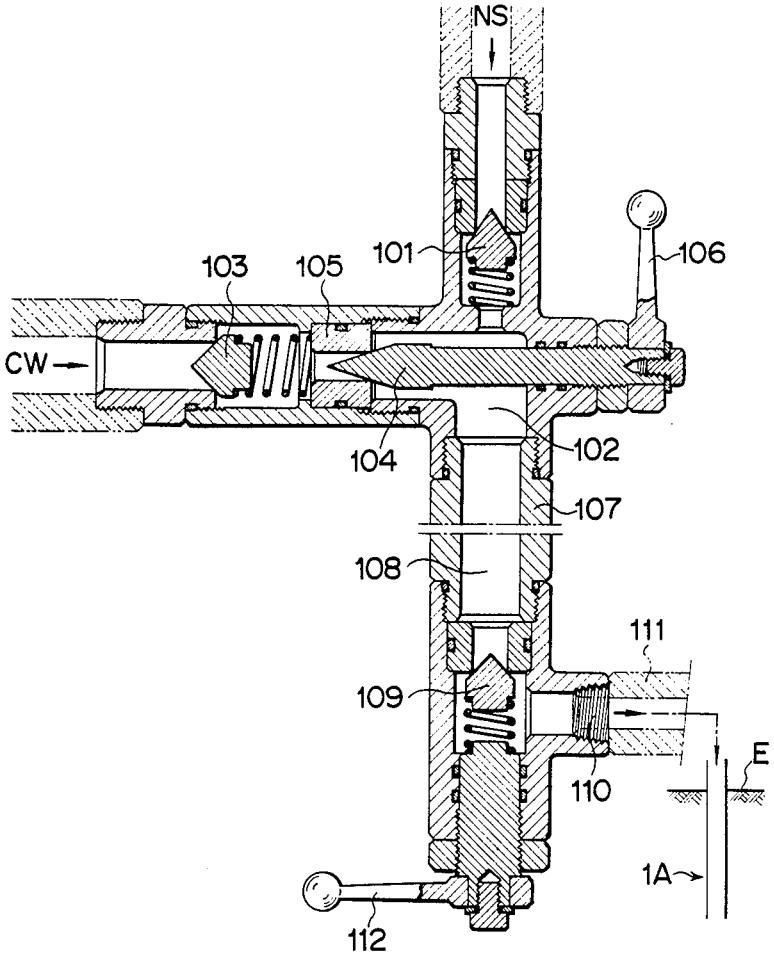
FIGS. 7, 8 and 9 are sectional views of other forms of pressure-holding valve.

Although the first and the second pressure-holding valve and the mixing section are provided within the injection tube, it may alternatively be provided outside of the tube as illustrated in FIG. 7. In FIG. 7, water glass NS supplied from a pump through a hose enters a mixing chamber 102 provided at an intersection, while pushing down a check valve 101. On the other hand, carbonated water CW supplied from a pump through a hose pushes down a check valve 103 and then passes through a space between a conical portion of a first pressure-holding valve 104 and a valve seat 105 to enter the mixing chamber 102, where the carbonated water is brought into contact with the water glass and mixed therewith. When the pressure for supplying the carbonated water is changed, an adjusting handle 106 may be operated to change a gap between the conical portion of the first pressure-holding valve 104 and the valve seat 105 to maintain the pressure determined by the first pressure-holding valve. A reacting chamber 108 having a long pipe path 107 is connected to the mixing chamber 102. The liquids are allowed to react sufficiently when they flow through the reacting chamber 108. A second pressure-holding valve 109 is provided downstream of the reacting chamber 108. The grout passes through the second pressure-holding valve 109 and is fed to a supplying hose 111 through an exit 110 and supplied to an injection tube lA. An actuating pressure of the second pressure-holding valve 109 is adjustable by a control handle 112.

Figure 8:
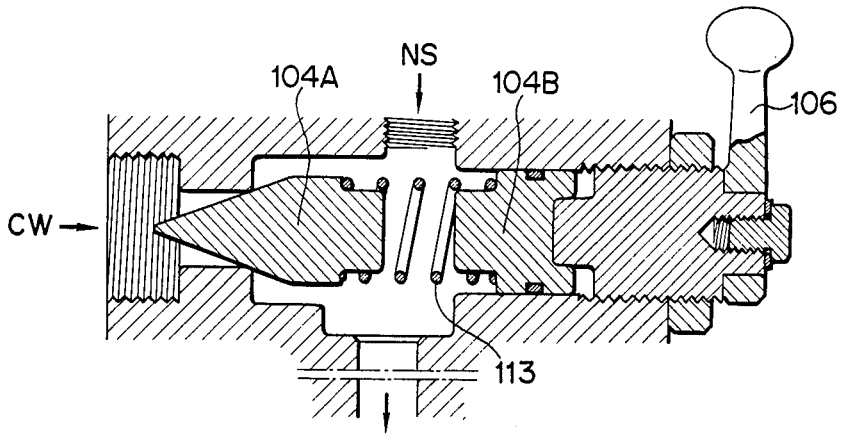

FIG. 8 illustrates another form of a pressure-holding valve system which is identical with that of FIG. 7 except that a first pressure-holding valve 104A is urged by a spring 113, the force of which is controllable by the control handle 106. In this case, a seat 104B for the spring 113 is displaced.

Figure 9:
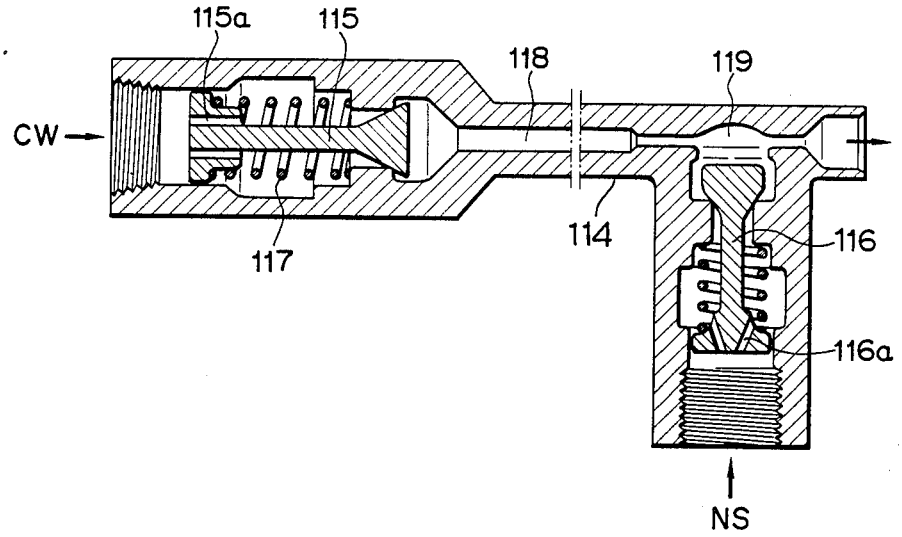
Figure 10:
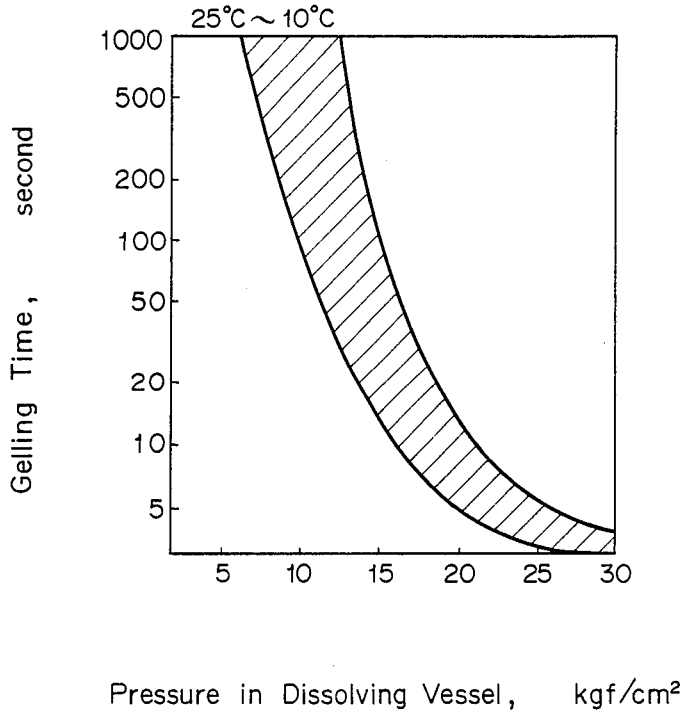
FIG. 10 is a diagram showing a relationship between a pressure within a dissolving vessel during the preparation of carbonated water and a gelling time of the resultant grout.

FIG. 9 illustrates a still another form of a pressure-holding valve system in which a first pressure-holding valve 115 and a check valve 116 are provided within a T-shaped casing 114. Carbonated water CW passes through a through hole 115*a* of the first pressure-holding valve 115 and pushes down the first pressure-holding valve 115 against the action of the spring 117. The carbonated water CW then passes through a long, narrow flow path 118 to reach a mingling chamber 119. The water glass NS passes through a through hole 116*a* to push down a check valve 116 and is then combined with the carbonated water CW at the mingling chamber 119. The mixed liquids are then guided through a mix accelerating path (not shown) to reach a second pressure-holding valve (not shown).

What is claimed is:

1. A grout impregnation method which uses an injection tube for contacting and mixing different kinds of materials supplied separately thereinto to prepare a grout and impregnates the grout into the earth through an injecting opening provided at a tip end of the tube, which method is characterized in that:

a first pressure-holding valve is provided within a higher-pressure path for one of the materials which is supplied under a higher pressure, a mixing section is provided downstream of said first pressure-holding valve but in the vicinity thereof for contacting and mixing said one of the materials with another one which is supplied under a lower pressure, and a second pressure-holding valve is provided downstream the mixing section;

said one of the materials is passed through said first pressure-holding valve, which reduces the pressure of said one of the materials, and then contacted and mixed with said another one at the mixing section;

said contacting and mixing is carried out under a pressure exceeding an atmospheric pressure and determined by the second pressure-holding valve; and the grout resulting from said contacting and mixing and passed through the second pressure-holding valve is impregnated into the earth through the injecting opening.

2. A grout impregnation method according to claim 1, wherein said first pressure-holding valve, said mixing section and said second pressure-holding valve are provided within the injection tube.

3. A grout impregnation method according to claim 1, wherein said first pressure-holding valve, said mixing section and said second pressure-holding valve are provided outside of the injection tube.

4. A grout impregnation method according to claim 1, wherein a feeding pressure of the material to be passed through said first pressure-holding valve is at least 1.2 times as high as that of the other material.

5. A grout impregnation method according to claim 1, wherein an actuation pressure of the first pressure-holding valve is 0.5 times or more and 1.5 times or less as compared with the feeding pressure of the material to be passed through the first pressure-holding valve.

6. A grout impregnation method according to claim 1, wherein an actuation pressure of the second pressure-holding valve is 5 $kg/cm^2G$ or higher, whereby the pressure within the mixing section is kept 5 $kg/cm^2G$ or higher.

7. A grout impregnation method according to claim 1, wherein said one of the materials is carbonated water and said another one is water glass.

8. A grout impregnation method according to claim 1, wherein said one of the materials is carbon dioxide gas and said another one is water glass.

9. A grout impregnation method according to claim 1, wherein the actuation pressures of the first and second pressure-holding valves are determined by springs each urging the valves towards the base end of the injection tube, respectively.

10. A grout impregnation method according to claim 1, wherein the materials are brought into contact with each other in the mixing section and the resultant mixture is forced to make at least one reciprocating flow directed towards the tip end of the injection tube and vice versa and finally led to be impregnated through the opening of the tube into the ambient earth.

11. A grout impregnation method according to claim 1, wherein a mixing accelerator is fitted in the injection tube, which accelerator has at least one reciprocating path which is directed towards the tip end of the tube and then vice versa, said reciprocating path being communicated with the injecting opening at the tip end of the injection tube.

* * * * *